United States Patent [19]

Torta

[11] Patent Number: 4,763,741

[45] Date of Patent: Aug. 16, 1988

[54] STEERING DEVICE FOR PAVED SURFACE CLEANERS

[75] Inventor: Nello Torta, Felegara di Medesano, Italy

[73] Assignee: Idroplina S.r.l., Sanguinaro di Fontanellato, Italy

[21] Appl. No.: 40,833

[22] Filed: Apr. 7, 1987

[30] Foreign Application Priority Data

Apr. 8, 1986 [IT] Italy ..... 21460/86[U]

[51] Int. Cl.[4] ..... B62D 11/08

[52] U.S. Cl. ..... 180/6.2; 15/50 R; 180/6.28; 180/19.3; 188/163

[58] Field of Search ..... 180/6.2, 6.28, 6.66, 180/19.3; 188/16, 163, 161; 15/50 R, 49

[56] References Cited

U.S. PATENT DOCUMENTS

| | | | |
|---|---|---|---|
| 3,166,141 | 1/1965 | Shields et al. | 180/6.2 X |
| 3,823,791 | 7/1974 | Sheler | 180/6.66 |
| 4,196,785 | 4/1980 | Downing, Jr. | 180/6.28 |

FOREIGN PATENT DOCUMENTS

| | | |
|---|---|---|
| 588251 | 5/1977 | Switzerland . |
| 1360261 | 7/1974 | United Kingdom . |
| 1376008 | 12/1974 | United Kingdom . |

*Primary Examiner*—John J. Love
*Assistant Examiner*—Mitchell J. Hill
*Attorney, Agent, or Firm*—Browdy and Neimark

[57] ABSTRACT

The invention relates to a steering device for paved surface cleaners, of a type commonly referred to as auto-scrubbers and comprising a first forward movement control assembly (11) having at least two manually seizable handle levers (13) for oscillation in an angular direction, an electric motor (8) controlled by the handle lever (13) oscillation, and two traction wheels (6) driven by the electric motor (8), and a second steering control assembly (12) independent of movements of the handle levers (13) and having at least two pushbutton controls (21*a*) located at the handle lever (13) ends and being actuatable manually, two electromagnets (19) connected electrically to said pushbutton controls (21*a*), and two brakes (9) for the traction wheels (6) applied selectively by the electromagnets (19).

5 Claims, 1 Drawing Sheet

STEERING DEVICE FOR PAVED SURFACE CLEANERS

BACKGROUND OF THE INVENTION

This invention relates to a steering device for paved surface cleaners of the self-propelled variety with no fixed steering or driver's station.

As is known, there are available on the market, and currently manufactured by the Applicant, machines for washing clean and drying the floors of warehouses, sheds, commercial establishments, and more generally, large surface area floorings. Such machines are commonly referred to as auto-scrubbers.

These are machines relatively compact in size which can poke into the narrowest corners of a storehouse, for example. They include a frame supporting a reservoir of clean washing water, a reservoir for foul regain water, clean water delivery members and foul water suction members, rotary brushes which are constantly wet with washing water, drive motors for said brushes, and at least one floor-wiping blade lying across the machine direction of travel and set rearwards of the brushes.

Being intended for cleaning large surfaces and to be a work implement proper, the machines in question are made self-propelled and equipped with a specific steering device. The steering device, moreover, is to provide highly responsive and effective steering control, because such machines are also to be driven along twisting and irregular paths.

However, such machines, or at least the most compact among them, owing to their small overall size, lack any fixed driver's compartment or steering station for the operator including a rest seat. The operator is to control the machine in a standing posture while walking behind it.

In view of the foregoing, it will be appreciated that the machine cannot be operated by means of pedal controls on a substantially continuous basis, since the operator's feet would be distracted therefrom.

Nor does the use of ordinary steering wheels appears to be appropriate or convenient, given that these devices only afford prompt control of the steering action proper and no forward and reverse running control, both hands of the operator being kept busy handling it.

It should be also considered that, with such relatively compact size machines for steering by a walking operator, it is not unusual for some movements to involve the operator's brawn, in order to impart rough travel path corrections. Steering wheels compel the operator to keep his hands close together in one machine area from where shifting by force and purely manual position corrections are difficult to apply.

Accordingly, it is common practice to provide, for controlling such machines, steering devices based upon the use of two handle levers set well apart on the rear side of the machine, in front of the walking operator behind it.

Each handle lever is positioned close to a fixed grip standing proud of the machine at a location from where the machine movements can be conveniently hand controlled.

In this case, the operator can leave the handle levers, if necessary, and presently seize said grips in the event that movements by hand become unavoidable.

The provision of two separate handle levers also enables actuation of a number of controls by hand only.

For these reasons, the Applicant has been manufacturing such type machines as are equipped with steering devices based on operation of two discrete handle levers.

There exists, however, with said handle levers the engineering problem of combining and arranging the various controls, both at the level of the handle levers and downstream thereof, for them to be simple and effective, and accordingly, easy to use and responsive and reliable in their actions.

It should be noted that the machines in question are sometimes operated by relatively unskilled personnel, and that it is therefore important, from the standpoint of safety as well, that the controls be kept simple and efficient.

The state of the art provides for shifting the handle levers toward the machine body to control forward travel, whereas shifting them away from the machine body controls reverse direction travel. Also, either levers have an articulated portion facing up in the inoperative position, on bending which parallel with the machine body, selective braking of the driving wheels is controlled via appropriate wire cables to drive the machine along a bending path.

Rotation of each articulated portion is to be effected toward the other lever, or inwards of the machine outline, to avoid hazardous protrusion while manoeuvering.

In other words, the operator walking behind such a machine turns the articulated portion of the left-hand lever rightwards, from his standpoint, to tension a wire cable braking a left-hand driving wheel, or turns the articulated portion of the right-hand lever leftwards to tension a wire cable braking a right-hand driving wheel. These manoeuvers respectively result in the machine turning to the left and the right.

That steering device, while being suitable for steering said machine types, still has drawbacks.

In fact, the movements that an operator is to perform in order to drive along a non-linear path are hardly natural ones and; above all, are far-reaching and tiring ones; the articulated portions of the handle levers must be constantly bent to selectively brake the driving wheels. Furthermore, relatively complex and easily inaccurate movements are required to both steer and speed up or slow down. The operator's fatigue due to such extensive and continued movements, and the likely inaccuracy of same on the occasion of complicated manoeuvers, may be a potential hazard for bystanders as well as for objects lying close to the cleaner path of movement.

SUMMARY OF THE INVENTION

This being the situation, the technical problem underlying this invention is to provide a steering device for cleaner machines as indicated which can substantially obviate the above-mentioned drawbacks.

Within the above technical aim, it is an important object of this invention to provide a device of simple construction, reliable in operation, and requiring no effort by an operator in any of its operating situations.

A further object of this invention is to provide a device which can be retrofitted to machine as specified above which incorporate the steering system described above, in lieu thereof.

The outlined technical aim and the objects specified hereinabove are substantially achieved by a steering device for paved surface cleaners, of a type comprising at least one first forward travel control assembly having two handle levers for manual oscillation thereof in an angular direction, an electric motor controlled by oscillation of said handle levers, and two traction wheels driven by said electric motor, and a second control assembly of the steering action acting selectively on brakes of said traction wheels, characterized in that said second control assembly is independent of movements of said handle levers and includes electric contact controls located on said handle levers and being operable manually to apply said brakes.

BRIEF DESCRIPTION OF THE DRAWINGS

Further features will become apparent from the description of a steering device as shown in the accompanying drawings, where.

DESCRIPTION OF THE PREFERRED EMBODIMENT OF THE INVENTION

Figure 1:
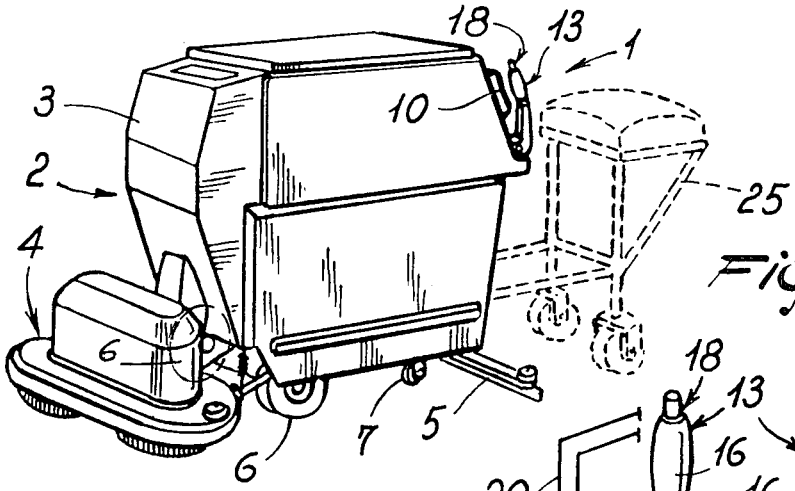
FIG. 1 is a perspective view of a cleaner machine incorporating the steering device of this invention.

With reference to the drawing figures, the device of this invention is indicated at 1. It is intended for steering control of a paved surface cleaner of the type referred to as "auto-scrubber" and indicated at 2 in FIG. 1.

Figure 2:
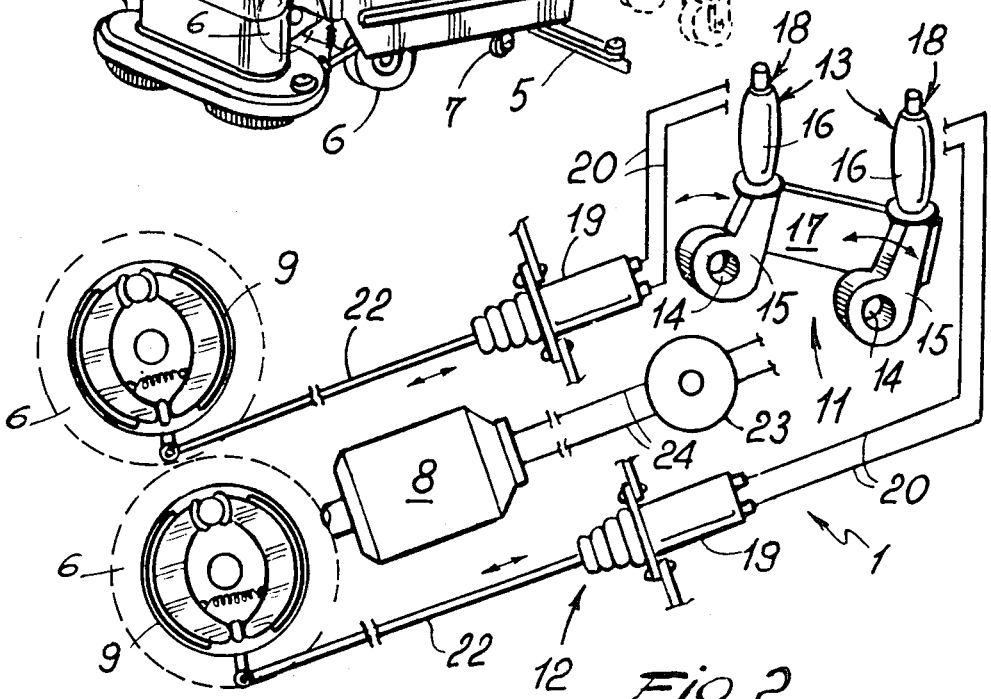
FIGS. 2 and 3 show the construction of the inventive steering device.
Figure 3:
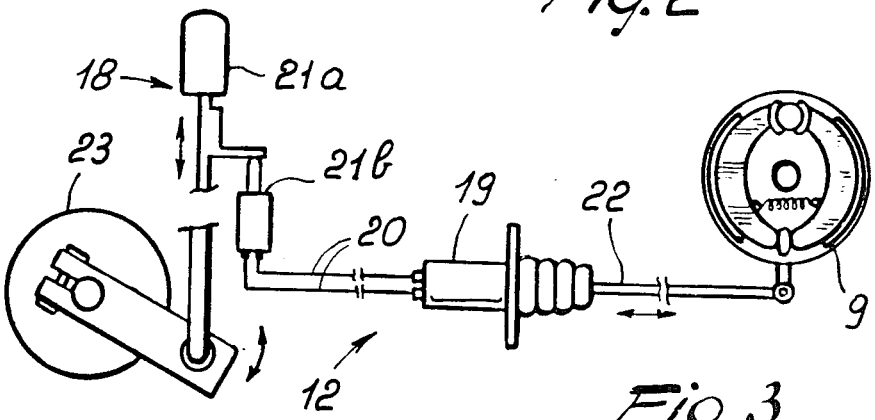

This machine 2 comprises, in a manner known per se, a case 3 substantially in the form of a compact block accommodating therein a first reservoir for clean washing water, a second reservoir for foul regain water, clean water delivery members and foul water suction members. Forwardly of the case 3 there is a brush assembly 4 accommodating brushes which are constantly wet with washing water and rotatable by motors overlying the brushes. Rearwardly of the case 3 there is a floor wiping blade 5 lying across the forward travel direction and being connected to the cited foul water suction members. Downwardly of the case 3 there are two front driving or traction wheels 6 and two rear casters 7. The traction wheels 6 are carried on two axles extending out of a differential gear. The two traction wheels 6 are driven rotatively by an electric motor 8 (FIG. 2) suitably coupled to a reduction gear included to the differential gearcase. Each traction wheel 6 is provided with a respective drum brake 9 (FIGS. 2 and 3).

The steering device 1 is located in the top rear area of the case 3 wherefrom there stand up two rigidly attached grips 10 set apart and located close to the corner edges of the case 3 (FIG. 1).

The device 1 of this invention includes a first control assembly 11 for controlling the machine forward movement, and a second control assembly 12 for steering the machine 2.

The first assembly 11 is expediently provided with handle levers 13 oscillating in an angular direction around a hinge bar extending through two holes 14 formed in bases 15 of the handle levers. The levers comprise handgrips 16 located in close proximity to the grips 10 (FIG. 1) and being a continuation of the bases 14.

Advantageously, as shown in FIG. 2, the handgrips 16 are supported rigidly, without any intermediate articulation, on the bases 15. Furthermore, the bases 15 of the two handle levers are interconnected rigidly by a plate 17. The levers 13 are therefore oscillable synchronously around the cited hinge bar.

Rotation of the hinge bar, and hence of the handle levers 13, will conventionally control the electric motor 8 and hence the machine 2 speed and forward or reverse direction movement. By means of the second assembly 12 it becomes instead possible to selectively apply the brakes 9 of each traction wheel 6 of the machine 1 to steer the same to a greater or lesser extent.

The second assembly 12 peculiarly comprises electric contact controls 18 having pushbutton controls **21*a* suitably arranged on the top ends of either levers 13, thereby an operator seizing the handgrips 16 can easily depress the pushbutton controls 21*a*. The latter are connected to two electromagnets 19**.

As shown in FIG. 3, the electromagnets 19 are connected at one end to the pushbutton controls **21*a* by electric cables 20 and auxiliary pushbuttons 21*b*, and at the other end to rigid tie rods 22. These are connected to the brakes 9 and control application of same on the electromagnets tensioning the rods 22**.

Depression of the pushbutton controls **21*a* will activate in parallel both the electromagnets 19 and means for variably opposing the flow of the current to the electric motor 8 comprising a rheostat 23. Said rheostat is connected to both pushbutton controls 21*a*, located in an electric power supply line 24 to the motor 8, and so constructed as to make an increased action of an electromagnet 19 on a brake 9 to result in an increased resistance to the flow of current through the line 24**.

The inventive steering device operates as follows.

The handle levers 13 are made rigid together to control forward and reverse travel of the machine 2; on rotating either lever 13 toward or away froim the case 3 of the machine 2 both levers are rotated to provide straight line forward or reverse movement of the machine 2.

To cause the machine 2 to turn while running either pushbutton control **21*a* should be instead depressed. Thus, through the auxiliary pushbutton 21*b* one electromagnet 19 will be energized to shift one rod 22 and apply one brake 9 to one traction wheel 6**.

Simultaneously with the energization of an electromagnet 19 and turning by braking either wheel, there also occurs a decrease in the speed of the machine 2 by operation of the rheostat 23 and hence reduction in the intensity of the current to the motor 8. The decrease is substantially proportional to the action of a brake of one traction wheel 6 and the sharper the path change the more is reduced the machine speed.

The efficiency of the steering device provided is enhanced, which has simple and naturally operable controls in all circumstances, requires no broad movements, comprises members which ensure prompt and effective actuation of the operator's controls, and offers technical solutions which facilitate, by the aforesaid slowing down, control of the machine where the control operations become most involved.

Owing to its simplicity the device 1 is of low cost and may be readily retrofitted to existing machines, since its members can be easily accommodated within the machines without any structural alterations. Thus, it becomes possible to improve safety and operability of currently sold "auto-scrubbers" as well.

Furthermore, actual tests have shown that the inventive device affords such safe and accurate driving conditions as to seldom require hand operation by force through the grips 10. Consequently, it also becomes possible to attach to the exterior of these machines an optional trailer seat 25 for the operator.

I claim:

1. A steering device for paved surface cleaners, comprising two manually seizable handle levers (13) for oscillation in an angular direction;

an electric motor (8) controlled by oscillation of said handle levers (13);

two traction wheels (6) driven by said electric motor (8);

each said traction wheel (6) being controllable by a respective brake (9);

and a second steering control assembly (12) acting selectively on said respective brakes (9) of each said traction wheel (6);

said steering control assembly (12) including: manually actuatable electric contact controls (18) located on said handle levers (13) for applying said brakes (9), two electromagnets (19) connected electrically to said electric contact controls (18), and at least two rigid tie rods (22) extending between said electromagnets (19) and said brakes (9), each said electromagnet (19) being connected at one end to one said electric contact control (18) and at the other end to one said brake (9).

2. A device according to claim 1, in which said steering control assembly (12) comprises a variable current opposing means (23) for variably opposing current electrically connected to said electric contact controls (18) and connected to said electric motor (8) so as to provide electrical power thereto, each said electric contact control (18) actuating a corresponding said electromagnet (19) on a respective one of said brakes (9) so as to cause said respective one of said brakes to exert a braking action on said respective traction wheel and cause said current opposing means (23) to increase opposition, in proportion to the braking action to current flowing to said electric motor (8) from said current opposing means (23).

3. A device according to claim 1, in which said electric controls (18) comprises two pushbutton controls (21*a*) each engaging one end of one of said handle levers (13).

4. A steering device for paved surface cleaners, comprising:

at least one first forward movement control assembly (11) having two manually seizable handle levers (13) for oscillation in an angular direction;

an electric motor (8) controlled by oscillation of said handle levers (13);

trwo traction wheels (6) driven by said electric motor (8);

each traction wheel being controllable by a respective brake;

and a second steering control assembly (12) acting selectively on said respective brakes (9) of each said traction wheel, said steering control assembly (12) including: manually actuatable electric contact controls (18) located on said handle levers (13) for applying said brakes (9), two electromagnets (19) connected electrically to said electric contact controls (18), at least two rigid tie rods (22) extending between said electromagnets (19) and said brakes (9), each said electromagnet (19) being connected at one end to one said electric contact control (18) and at the other end to one said brake (9), and one rheostat (23) electrically connected to said electric contact controls (18) and connected to said electric motor (8) so as to supply power thereto, each said electric contact control (18) actuating said electromagnet (19) on a respective one of said brakes (9) so as to cause said respective one of said brakes to exert a braking action on said respective traction wheel and cause said rheostat (23) to increase opposition, in proportion to said braking action, to current flowing to said electric motor (8) from said current opposing means (23).

5. A steering device for paved surface cleaners, comprising:

a case (3);

at least one first forward movement control assembly (11) having two manually seizable handle levers (13) for oscillation in an angular direction;

said handle levers including bases (15), handgrips (16) carried rigid on said bases (15), pushbutton controls (21*a*) standing up from the free ends of said handgrips (16) and a plate (17) engaging said bases (15) rigidly together;

fixed grips (10) rigidly attached to said case (3) in close proximity to said handgrips (16); an electric motor (8) controlled by oscillation of said handle levers (13); two traction wheels (6) driven by said electric motor (8), each traction wheel (6) being controllable by a respective brake (9), and a second steering control assembly (12) acting selectively on said respective brakes (9) of each said traction wheel (6), said steering control assembly (12) including: electric contact controls (18) actuated by said pushbutton controls (21*a*) to apply said brakes (9), two electromagnets (19) connected electrically to said electric contact controls (18), and at least two rigid tie rods (22) extending between said electromagnets (19) and said brakes (9), each said electromagnet (19) being connected at one end to one said electric contact control (18) and at the other end to one said brake (9).

* * * * *